United States Patent [19]

Day

[11] Patent Number: 4,542,611

[45] Date of Patent: Sep. 24, 1985

[54] DOUBLE GLASS SHEET INSULATING WINDOWS

[76] Inventor: Ralph K. Day, 307 W. Harrison Ave., Maumee, Ohio 43537

[21] Appl. No.: 504,836

[22] Filed: Jun. 16, 1983

Related U.S. Application Data

[63] Continuation-in-part of Ser. No. 255,160, Apr. 17, 1981, abandoned.

[51] Int. Cl.[4] ..... E06B 7/12

[52] U.S. Cl. ..... 52/172; 52/790

[58] Field of Search ..... 52/304, 307, 308, 171, 52/172, 788–790

[56] References Cited

U.S. PATENT DOCUMENTS

| | | | |
|---|---|---|---|
| 520,226 | 5/1894 | Weyhe | 52/171 |
| 1,852,661 | 4/1932 | Larkin | 52/1 |
| 1,913,703 | 6/1933 | D'Adrian | 52/172 |
| 2,597,097 | 5/1952 | Haven | 52/172 |
| 3,001,249 | 9/1961 | Elton et al. | 52/172 |
| 3,570,201 | 3/1971 | Barroero | 52/172 |
| 3,810,331 | 5/1974 | McCurdy et al. | 52/172 |
| 3,865,239 | 8/1972 | McCurdy et al. | 52/172 |
| 3,981,111 | 9/1976 | Berthagen | 52/790 |
| 4,065,894 | 1/1978 | Day | 52/172 |

FOREIGN PATENT DOCUMENTS

| | | | |
|---|---|---|---|
| 1226767 | 10/1966 | Fed. Rep. of Germany | 52/171 |

*Primary Examiner*—James L. Ridgill, Jr.
*Attorney, Agent, or Firm*—David H. Wilson

[57] ABSTRACT

A window structure includes a pair of panes of glass maintained in spaced apart relationship by a separating unit to define an interior chamber between the panes substantially impervious to the ambient atmosphere. The separating unit includes a pressure equalization device for controlling the volume of the chamber to maintain the interior chamber pressure substantially equal to the ambient atmospheric pressure. The separating unit can also include a desiccant-filled container in fluid communication with the chamber for dehydrating air within the chamber.

7 Claims, 2 Drawing Figures

DOUBLE GLASS SHEET INSULATING WINDOWS

CROSS REFERENCE TO RELATED APPLICATION

This application is a continuation-in-part of my copending application Ser. No. 255,160, filed Apr. 17, 1981, now abandoned.

BACKGROUND OF THE INVENTION

1. Field of the Invention

This invention relates generally to improvements in multiple glass sheet windows and, more particularly, to a double-sheet glass window having a space between the individual sheets, and including means for drying the air within the space and equalizing its pressure with the ambient atmosphere.

2. Description of the Prior Art

As is well known, multiple sheet window units have been widely used for reducing the transfer of heat and abating the transfer of sound. Such units generally comprise a pair of spaced glass sheets which are hermetically sealed together around their peripheral edges to form a dead-air space or chamber therebetween. This space or chamber may be filled with dehydrated air, other gas, or exhausted to provide a partial vacuum therein for preventing condensation of moisture upon the inside surfaces of the glass sheets. The efficiency of this style of window unit is dependent largely upon maintaining the space between the glass sheets hermetically sealed.

At least two major problems are presented by this style of window, one being the control of moisture condensation within the dead-air space and the other being pressure compensation of the air within the space. If the air or gas within the dead-air space contains even the slightest amount of water vapor, changes in the temperature and pressure of the air or gas within the space, and changes in the temperature of the glass sheets themselves may cause condensation to form on the inside surfaces of the glass sheets. Also, should the slightest leak develop permitting humid air to enter the space between the glass sheets and the ambient temperature drops, condensation of moisture occurs between the glass sheets. Since there is no circulation between the ambient air and the space between the glass sheets, the glass sheets will remain fogged for substantial periods of time which, of course, is quite detrimental to good visibility.

Concurrently, changes in the pressure of the air within the dead-air space, as well as changes in the ambient air pressure, exert varying forces on the glass sheets. When the sheets of glass employed in the units are relatively small, the effect of air pressure variations is of no concern. However, when the sheets of glass are relatively large, the glass sheets may be visibly distorted. In some instances, the flexing or bowing of the glass sheets is so pronounced as to spoil the aesthetic appearance of the units and, in other instances, the glass sheets may even be broken by the stresses generated by severe pressure variations.

Attempts have been made in the past to overcome these problems. For example, U.S. Pat. No. 3,001,249, issued to Elton et al. discloses a moisture-permeable plastic container containing a desiccant therein disposed within a hermetically sealed air space of the window unit. Elton et al. further discloses the use of a flexible plastic tube which functions to equalize the pressure within a closed space surrounding the hermetically sealed air space for mitigating rupturing or damage of the hermetic seal from extraneous forces.

U.S. Pat. No. 3,810,331, issued to McCurdy et al. discloses a dehydrating central air pressure system which communicates with the air spaces of a number of hermetically sealed dual-sheet windows for controlling the quantity of moisture of the air contained within the air spaces and the pressure thereof. Of course, this system is very costly, which prohibits its use when small numbers of dual window units are required, for example, in residential housing.

U.S. Pat. No. 3,570,201, issued to Barroero, discloses a curved two-pane door structure having a desiccant-containing breather tube for providing communication between the air space between the curved glass panes and the ambient atmosphere for controlling the moisture content and pressure of the air contained within the air space. However, this system is not entirely satisfactory as it is solely dependent upon the changes in ambient air pressures for its effectiveness.

SUMMARY OF THE INVENTION

The present invention relates to a dual pane glass window structure having both a moisture control device and a pressure equalization device located between the facing surfaces of the two panes of glass. More specifically, the window structure comprises two panes of glass arranged in spaced apart, parallel relationship by a separating means extending around the peripheral edges of the panes for defining an interior air chamber therebetween substantially impervious to the ambient atmosphere. The separating means can include a desiccant-filled container disposed inwardly of the marginal edges of the panes along one edge portion of the panes for removing moisture from the air within the interior chamber. The separating means can also include a pressure equalization means such as an air impervious, flexible bladder extending along another edge portion of the panes and responsive to the ambient atmospheric pressure for maintaining the interior chamber pressure substantially equal to the ambient atmospheric pressure.

An object of this invention is to produce a multiple sheet insulating window unit having at least two panes of glass maintained in spaced apart, parallel relationship by a separating means disposed adjacent the peripheral marginal edge of the glass panes to define a chamber therebetween provided with moisture control and pressure equalization means.

BRIEF DESCRIPTION OF THE DRAWINGS

The above, as well as other objects and advantages of the invention, will become readily apparent to one skilled in the art from reading the following detailed description when considered in the light of the accompanying drawings, in which.

DESCRIPTION OF THE PREFERRED EMBODIMENT

Although the invention will be described in conjunction with a rectangularly shaped insulating window, it should be understood that the invention is equally adaptable to window units having other shapes and that the desiccating device and pressure equalizing device need only extend along portions of the units.

Figure 1:
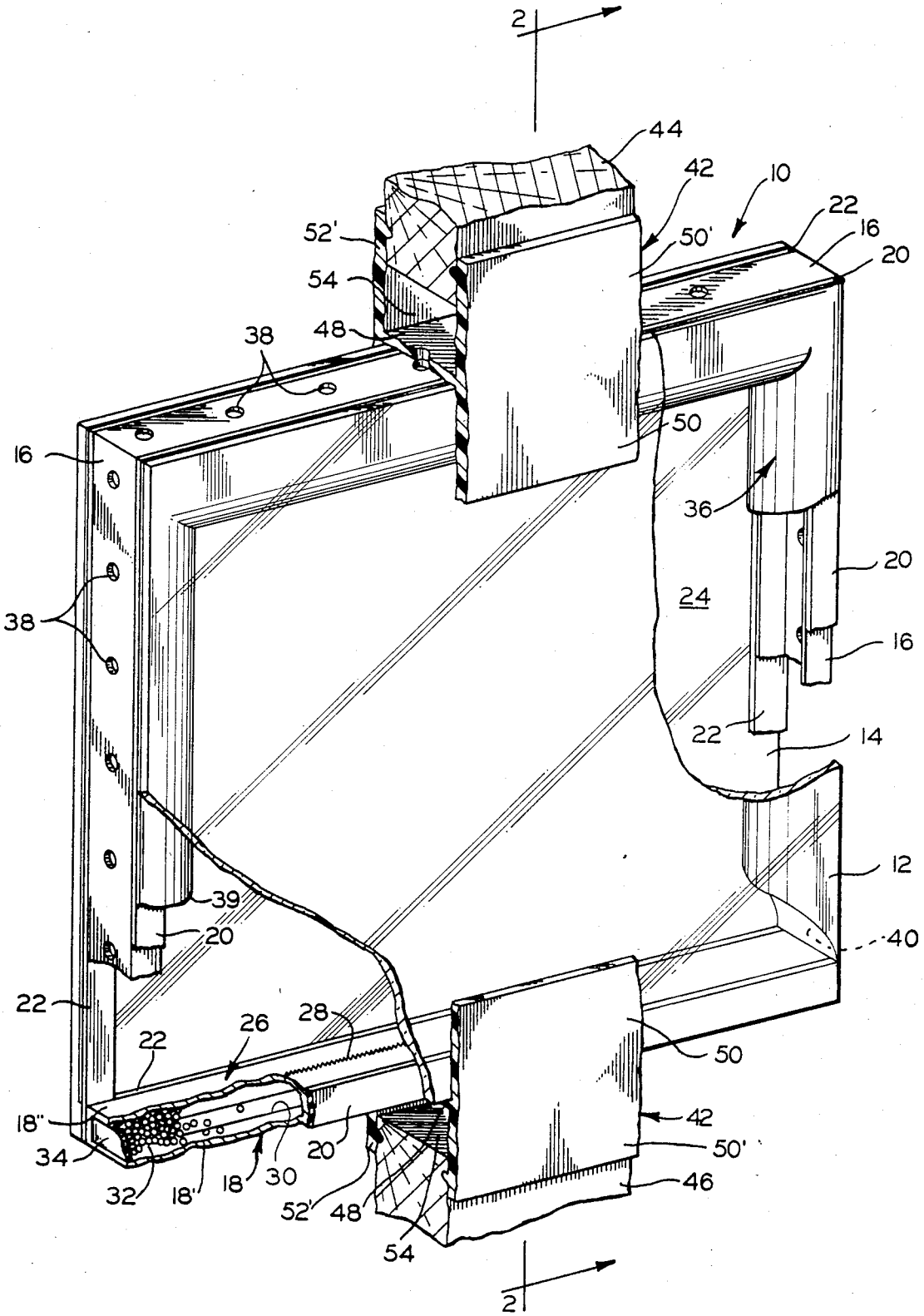
FIG. 1 is a perspective view of the two-sheet glass window unit embodying the invention and having portions broken away for clairty.
Figure 2:
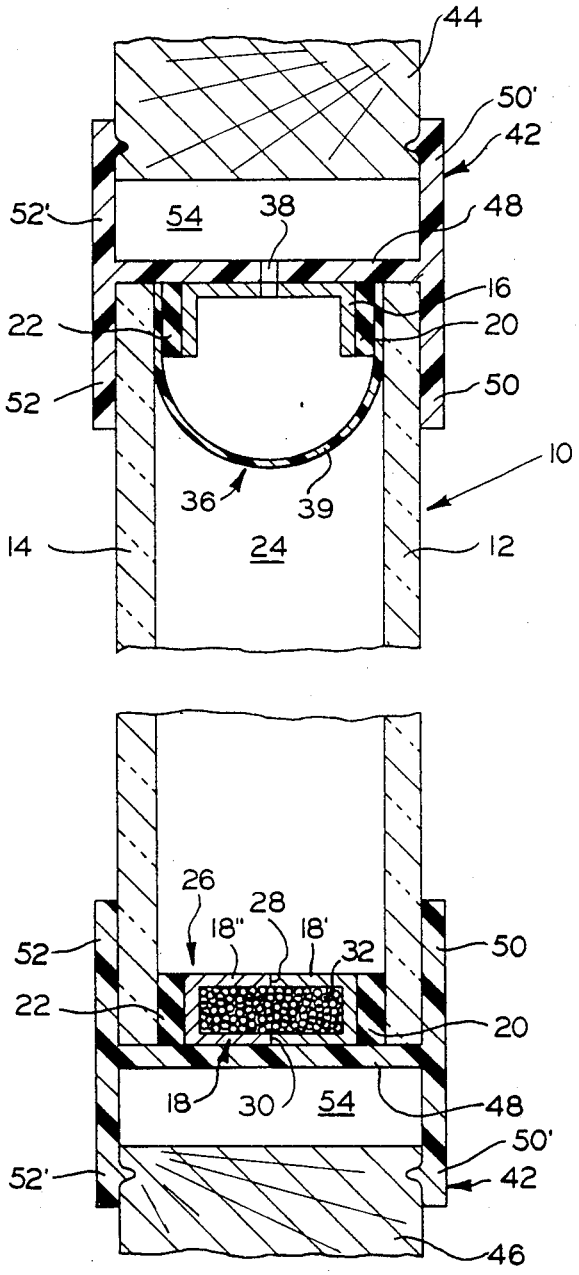
FIG. 2 is an enlarged cross-sectional view taken substantially along line 2—2 of FIG. 1.

Referring now to FIG. 1, there is illustrated a rectangularly shaped multiple glass sheet window unit constructed in accordance with the invention and designated in its entirety by the reference numeral 10. The unit 10 generally comprises two sheets or panes of glass 12 and 14 arranged in spaced parallel facing relationship by a series of spacer members or bars 16 and a hollow spacer member 18 which extend around the peripheral marginal facing edges of the glass sheets 12 and 14. The spacer members 16 and 18 together with resilient components such as elongate gasket strips 20 and 22 typically formed of a closed cell elastomeric material such as sponge rubber or the like, define a closed interior chamber 24 between the facing surfaces of the glass sheets 12 and 14. The resilient gaskets permit the glass sheets to be compressibly held against the spacer members so that air flow into the chamber is confined to a defined passage.

The basic concept of the invention contemplates controlling the moisture content and equalizing the pressure of the air within the chamber 24 with the pressure of the atmospheric air by separating the moisture condensation control from the pressure equalization control.

To this end, a desiccant device 26 including the hollow spacer member 18 constitutes a first section of the separating means. The hollow member 18 may be formed from two elongate channel members 18' and 18'', U-shaped in cross-section and having the edges of their flanges in abutting relation. The upper edges of the flanges adjacent the chamber 24 are serrated as at 28 for permitting the passage of air between the chamber 12 and the interior of the desiccant device 26. The lower edges of the flanges are sealed together at 30 such that the interior of the desiccant device 26 is substantially impervious to the ambient atmosphere. The interior of the hollow member 18 is filled with a desiccant material 32 of suitable composition either in granular or solid form. The desiccant material 32 is contained within the member 18 by sealing the ends with a suitable sealant material 34. Preferably, the gasket strips 20 and 22 extending along each side of the hollow spacer member 18 are formed of a non-porous resilient material and adhesively secured to at least the spacer member 18.

A pressure equalization device 36 extending into the chamber 24 includes spacer members 16 and constitutes a second section of the separating means. Each spacer member 16 may comprise a channel-shaped member having a number of spaced holes 38 extending through the web thereof. Preferably, the gasket strips 20 and 22 extending along the spacer members 16 are formed of a resilient non-porous material and adhesively secured to at least the members 16. However, the gasket strips 20 and 22 extending along the members 16 may be formed from a resilient porous-type material. An elongate, flexible strip 39 of air impervious plastic material extends along the spacer members 16 and has its longitudinal free edges interposed between the gasket strips 20 and 22 and the facing surfaces of the glass sheets 12 and 14. Each end of the flexible plastic strip 39 is suitably sealed, as at 40, to the adjacent surface of the spacer member 16. The flexible plastic strip or bladder 39, in communication with the ambient atmosphere through the holes 38, expands and contracts in response to changes in atmospheric pressure and temperature relative to the air pressure and temperature in the chamber 24 to maintain the interior chamber pressure substantially equal to the ambient atmospheric pressure.

Although components of the window unit 10 will be described as being compressibly held in assembled relationship in a suitable frame 42 of H-shaped cross-section, it should be understood that window components may be held in assembled relationship by a series of clips or like devices (not shown) for being mounted as a unit in a structural building opening. As illustrated in the drawing figures, the frame 42 is adapted to be mounted in an opening defined by wood sashes 44 and 46 of a building structure (not shown). More particularly, the marginal edges of the unit 10 are positioned adjacent a web 48 interconnecting the legs 50 and 52 of the H-shaped frame 42, while the legs 50 and 52 compress glass sheets 12 and 14 against the spacer members 16 and 18 through the resilient gasket strips 20 and 22. It should be noted that the portions 50' and 52' of the legs 50 and 52 supporting the unit 10 in the sashes 44 and 46 mount the unit 10 in spaced relation thereto. This arrangement provides a passage 54 for the ambient atmosphere to surround the unit 10.

In view of the above description, it will be appreciated that a window unit incorporating the features of the invention produces an assembly which requires no mastic or putty for insulation, and on site assembly and disassembly is facilitated. These features are realized due to the fact that the two-glass sheet structure may be easily inserted within various styles of sash frame elements. Further, should one or both sheets of glass be broken, replacement can be effected on site by removing structure from the sash elements; replacing the broken glass sheet or sheets, and if necessary, the gasket strips, as well as the associated bladder. The structure is then reassembled and reinserted into the sash frame elements.

Furthermore, the structural arrangement of the window unit lends itself to converting existing single glazed windows into two-sheet glass insulating windows resulting in an energy efficient structure with minimal expense of time and money.

It is to be understood that the form of the invention herewith shown and described is to be taken as a preferred embodiment only of the same and that various changes in the shape, size, and arrangement of the parts may be resorted to without departing from the spirit of the invention.

What is claimed is:

1. A multiple pane window structure comprising:

a pair of spaced apart panes of glass having an outer periphery defined by the outer marginal edges of said panes;

separating means between the facing surfaces of said panes for maintaining said panes in generally fixed, parallel, spaced apart relationship;

sealing means substantially impervious to the ambient atmosphere extending between and sealed to the spaced apart panes to define a chamber between said panes, said sealing means including pressure equalization means disposed inwardly of the marginal edges of said panes between the facing surfaces of said panes, said pressure equalization means being responsive to the ambient atmospheric pressure for altering the volume of said chamber to maintain the interior chamber pressure substantially equal to the ambient atmospheric pressure.

2. A multiple pane window structure according to claim 1 including clamping means engaging the outer surfaces of said panes to compressibly hold said panes against said separating means.

3. A multiple pane window structure according to claim 1 wherein said pressure equalization means includes a strip of ambient atmosphere impervious flexible material connected between the facing surfaces of said panes and extending along at least a portion of said sealing means, said strip having an outer surface exposed to the ambient atmospheric air and having an inner surface exposed to the chamber air.

4. A multiple pane window structure according to claim 1 wherein said sealing means includes a desiccant-filled container disposed inwardly of the marginal edges of said panes between the facing surfaces of said panes, said container having an interior in fluid communication with said chamber for dehydrating air within said chamber.

5. A multiple pane window structure according to claim 4 wherein said sealing means includes a first section extending around a portion of the outer periphery of the panes and a second section extending around the remaining portion of the periphery, said desiccant-filled container being associated with said first section of said sealing means and said pressure equalization means being associated with said second section of said sealing means.

6. A multiple pane window structure according to claim 1 wherein said separating means comprises an elongate spacer bar extending around a portion of the periphery of said panes between the facing surfaces of said panes.

7. A multiple pane window structure according to claim 6 wherein said pressure equalization means includes a strip of ambient atmosphere impervious, flexible material connected between the facing surfaces of said panes and positioned on the chamber side of said spacer bar and extending along at least a portion of said spacer bar, said spacer bar having an aperture to vent the outer surface of said strip to the ambient atmosphere.

* * * * *